US006582262B2

(12) United States Patent
Fukuda et al.

(10) Patent No.: US 6,582,262 B2
(45) Date of Patent: Jun. 24, 2003

(54) FOUR-STROKE-CYCLE ENGINE OF AN OUTBOARD MOTOR

(75) Inventors: Katsuhiro Fukuda, Hamamatsu (JP); Jiro Saiga, Hamamatsu (JP); Yasushi Miyashita, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/189,414

(22) Filed: Jul. 8, 2002

(65) Prior Publication Data

US 2003/0013362 A1 Jan. 16, 2003

(30) Foreign Application Priority Data

Jul. 10, 2001 (JP) ..... 2001-209738

(51) Int. Cl.[7] ..... B65H 21/38
(52) U.S. Cl. ..... 440/88.1
(58) Field of Search ..... 440/88, 77; 123/90.13, 123/90.15, 90.17, 90.34

(56) References Cited

U.S. PATENT DOCUMENTS 4,811,698 A * 3/1989 Akasaka et al. ..... 123/90.17
4,862,843 A * 9/1989 Kawamoto et al. ..... 123/90.17
5,058,539 A * 10/1991 Saito et al. ..... 123/90.17
5,743,228 A * 4/1998 Takahashi ..... 440/77
5,816,205 A * 10/1998 Moriya ..... 123/90.17
5,901,674 A * 5/1999 Fujiwaki ..... 123/90.17
6,032,629 A * 3/2000 Uchida ..... 123/90.34
6,035,817 A * 3/2000 Uchida ..... 123/90.17
6,053,139 A * 4/2000 Eguchi et al. ..... 123/90.17
6,076,492 A * 6/2000 Takahashi ..... 123/90.17
6,318,313 B1 * 11/2001 Moriya et al. ..... 123/90.15
6,374,786 B1 * 4/2002 Ogawa ..... 123/90.17
6,439,938 B1 * 8/2002 Katayama ..... 440/88

* cited by examiner

*Primary Examiner*—S. Joseph Morano
*Assistant Examiner*—Lars A. Olson
(74) *Attorney, Agent, or Firm*—Oblon, Spivak, McClelland, Maier & Neustadt, P.C.

(57) ABSTRACT

A four-stroke-cycle engine of an outboard motor, comprises an engine body, a crankshaft, at least one camshaft, at least one camshaft driving mechanism, an oil pump, at least one valve timing adjusting mechanism and at least one valve timing controlling mechanism. The crankshaft and the camshaft are disposed in an upright state in the engine body. The camshaft driving mechanism transmits a rotational motion of the crankshaft to the camshaft. The camshaft driving mechanism is disposed on a lower side of an engine body. The oil pump for lubrication is disposed on the lower side of the engine body. Oil is supplied from the oil pump to the valve timing controlling mechanism to control the valve timing adjusting mechanism. The valve timing controlling mechanism is disposed on a lower side of an outer wall of a valve train chamber in which the camshaft is received.

6 Claims, 7 Drawing Sheets

FOUR-STROKE-CYCLE ENGINE OF AN OUTBOARD MOTOR

BACKGROUND OF THE INVENTION

The present invention relates a four-stroke-cycle engine of an outboard motor provided with a mechanism for adjusting or varying a valve timing.

In general, a four-stroke-cycle engine to be mounted on an outboard motor is fabricated into a vertical type in which a crankshaft and a camshaft are disposed in an upright state in the engine. A camshaft driving mechanism for transmitting a rotational motion of the crankshaft to the camshaft is disposed on an upper or lower surface of the engine. The camshaft driving mechanism includes a chain, a belt or a gear train.

The four-stroke-cycle engine is provided on its lower side with an oil pan so that oil reserved therein can be pumped out by means of oil pump to supply the oil to respective portions to be lubricated in the engine. The oil pump is usually disposed on the lower surface of the engine so that rotation of the crankshaft or camshaft is transmitted to the oil pump through an oil pump driving mechanism.

A mechanism for adjusting or varying the valve timing, hereinlater called "valve timing adjusting mechanism", which has already used widely in an engine for a vehicle such as an automobile and a motorcycle, has recently been used also in the four-stroke-cycle engine of an outboard motor. Such a mechanism shifts a rotational phase angle of the camshaft, which rotates at half (½) rotational speed of the crankshaft, in an advance angle direction in a high-revolution range rather than a low- or middle-revolution range, to provide appropriate valve timing all over the rotational range. The valve timing adjusting mechanism is provided on the end of the camshaft.

The valve timing adjusting mechanism is actuated through the oil supply from the oil pump. The oil pumped out by means of the oil pump is supplied first to a valve timing controlling mechanism and then to the valve timing adjusting mechanism. The valve timing controlling mechanism is disposed in the vicinity of the engine body so as to be connected to the valve timing adjusting mechanism.

However, in addition to a large size of the four-stroke-cycle engine, since many devices such as the camshaft driving mechanism, the oil pump, the oil pump driving mechanism, valve timing adjusting mechanism and the valve timing controlling mechanism are disposed on the engine body, as well as additional disposition of a gas-liquid separation chamber for a an intake system (including an air cleaner) having a prescribed volume, the entire structure of the engine is made inevitably large, providing a significant disadvantage for the structure of the outboard motor, and hence, it is required to provide a four-stroke-cycle engine of the outboard motor having a compact structure.

In addition, in the conventional structure of the engine, the valve timing controlling mechanism is placed so as to be apart from the engine body, and therefore, there increase the length of an oil passage between the oil pump and the valve timing controlling mechanism and the length of the other oil passage between the valve timing controlling mechanism and the valve timing adjusting mechanism, thus increasing passage loss of hydraulic (oil) pressure, which deteriorates the actuating response of the valve timing adjusting mechanism.

Furthermore, in the conventional structure, it is necessary to provide oil passages in the form of external piping, which are connected to the oil pump and the valve timing adjusting mechanism, on the valve timing controlling mechanism, which is placed apart from the engine body, thus increasing the number of necessary structural parts and the number of assembling steps, which involves cost increasing.

SUMMARY OF THE INVENTION

An object of the present invention is to substantially eliminate defects or disadvantages encountered in the prior art mentioned above and, therefore, to provide a four-stroke-cycle engine of an outboard motor, which makes it possible to improve the actuating response of the valve timing adjusting mechanism, to provide improved properties of layout-designing and downsizing of the engine and to reduce manufacturing cost.

This and other objects can be achieved according to the present invention by providing, in a general aspect, a four-stroke-cycle engine of an outboard motor, comprising:

an engine body;

a crankshaft disposed in an upright state in the engine body of the engine in an upright state;

at least one camshaft disposed in an upright state in the engine body;

at least one camshaft driving mechanism for transmitting a rotational motion of the crankshaft to the camshaft, the camshaft driving mechanism being disposed on a lower side of the engine body;

an oil pump for lubrication disposed on the lower side of the engine body;

at least one valve timing adjusting mechanism; and at least one valve timing controlling mechanism to which an oil is to be supplied from the oil pump to control the valve timing adjusting mechanism, the valve timing controlling mechanism being disposed on a lower side of an outer wall of a valve train chamber in which the camshaft is received.

According to the structure of this general aspect of the present invention, the valve timing controlling mechanism is placed closely to the oil pump and the valve timing adjusting mechanism so as to decrease the length of an oil passage extending from the oil pump to the valve timing controlling mechanism as well as the length of an oil passage extending from the valve timing controlling mechanism to the valve timing adjusting mechanism, thus reducing passage loss of oil and improving the actuating response of the valve timing adjusting mechanism.

In addition, according to this aspect, it is unnecessary to provide the valve timing controlling mechanism with any oil passages in the form of external piping, which are connected to the oil pump and the valve timing adjusting mechanism. Accordingly, it is possible to form the oil passages within the engine so as to provide improved properties of the layout-designing and downsizing of the engine, thus decreasing the number of necessary structural parts and the number of assembling steps.

In a preferred embodiment of the above aspect, the valve timing adjusting mechanism is disposed on a lower end side of the camshaft and below the camshaft driving mechanism.

According to this feature, it is possible to make effective use of a space below the engine so as to provide the more improved properties of the layout-designing and downsizing of the engine and to reduce the distance between the valve timing adjusting mechanism and the valve timing controlling mechanism so as to remarkably improve the actuating response of the valve timing adjusting mechanism.

In a preferred embodiment, the four-stroke-cycle engine further comprises an intake device including a gas-liquid separation chamber, which is disposed on an upper side of the engine body.

According to this feature, the gas-liquid separation chamber and the valve timing adjusting mechanism are disposed on the upper and lower sides of the engine, respectively, to thereby cause no spatial interference with each other, thus providing the improved properties of the layout-designing and downsizing of the engine.

In a further preferred embodiment, the engine is a double-over-head-camshaft (DOHC) type engine, at least one camshaft comprises first and second camshaft members, the camshaft driving mechanism is configured so that the rotational motion of the crankshaft is transmitted to the first camshaft member through a chain and a rotational motion of the first camshaft member is transmitted to the second camshaft member through a gear train; the valve timing adjusting mechanism is disposed on a lower end of the first camshaft to be driven by a chain; the oil pump and an oil pump driving mechanism are disposed in a region on a side opposite to the first camshaft member to be driven by a chain relative to an axial line of a cylinder of the engine in a plan view; and a rotational motion of the second camshaft member to be driven by a gear is transmitted to the oil pump through the oil pump driving mechanism.

According to the additional features, the valve timing adjusting mechanism provided on the camshaft to be chain-driven can substantially be leveled with the oil pump and the oil pump driving mechanism, which are provided on the camshaft to be gear-driven in a side view of the engine, thus making effective use of the space below the engine and providing the more improved property of downsizing the engine.

In a further preferred embodiment, the engine is a double-over-head-camshaft and V-type engine having a V-shape bank in a plan view and the valve timing adjusting mechanism is disposed for the camshaft disposed inside the V-shape bank. Further, at least one camshaft may comprise first and second pairs of camshaft members, the first pair of camshaft members comprising a first inner camshaft member and a first outer camshaft member, which are disposed in a first bank of the V-type engine, and the second pair of camshaft members comprising a second inner camshaft member and a second outer camshaft member, which are disposed in a second bank of the V-type engine, the first and second inner camshaft members being located between the first and second outer camshaft members in the plan view, and the at least one valve timing adjusting mechanism comprises first and second valve timing adjusting devices provided for the first and second inner camshaft members, respectively.

According to such additional features, the valve timing adjusting mechanism having a relatively large diameter is placed in the inner side in the lateral direction of the engine, to thereby reduce the entire width of the engine, thus providing the more improved property of downsizing the engine.

It is to be noted that the nature and further characteristic features of the present invention will be made more clear from the following descriptions made with reference to the accompanying drawings.

DESCRIPTION OF THE PREFERRED EMBODIMENTS

Figure 1:
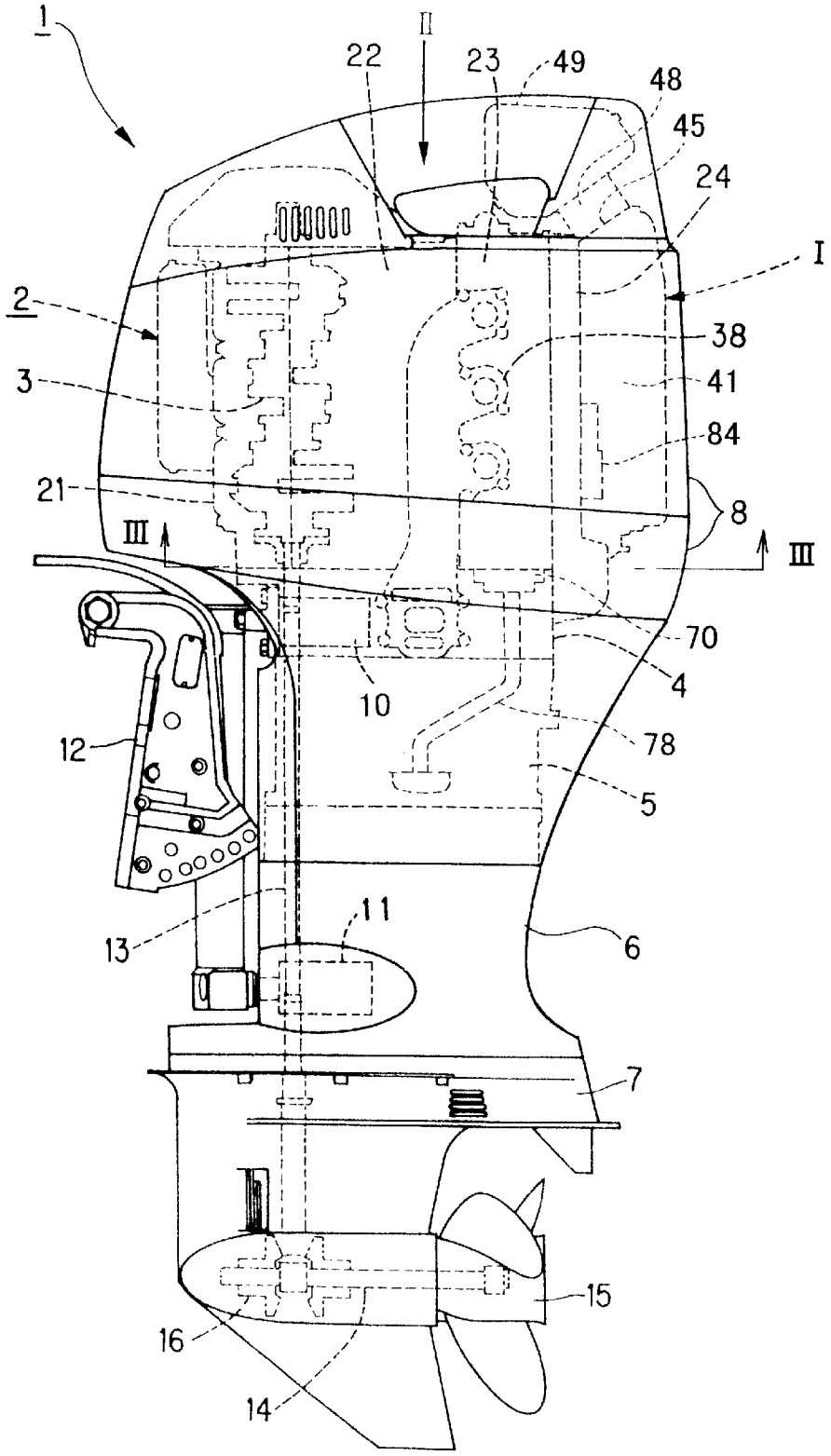
FIG. 1 is a left-hand side view illustrating an example of an outboard motor to which a four-stroke-cycle engine of the present invention is mounted.

A first embodiment of a four-stroke-cycle engine of an outboard motor of the present invention will be described hereunder with reference to the accompanying drawings of FIGS. 1 to 3. In FIG. 1, the left-hand side corresponds to the front side (i.e., hull side of a boat or like to which the outboard motor is mounted) and the right-hand side corresponds to the rear side.

An engine 2, which may be exemplified as a V-type six-cylinder water-cooled four-stroke-cycle DOHC (double-over-head-camshaft) engine, is mounted on an uppermost portion of an outboard motor 1. This engine 2 is stationarily mounted on an upper surface of an engine holder 4 having a flat plate structure so that a crankshaft 3 is disposed in the engine in a perpendicularly extending upright state. An oil pan 5 is stationarily mounted to a lower surface of the engine holder 4. A drive housing 6 is fixed to a lower portion of the oil pan 5, and a gear housing 7 is fixed to a lower portion of the drive housing 6. The engine 2, the engine holder 4 and the part of the oil pan 5 are surrounded with an engine cover, i.e. cowling 8, which is dividable into upper and lower parts.

Further, as can be understood from the above description, terms of "upper", "lower", "front", "rear" and the like are used herein with reference to the illustrations on the drawings or in an usual mounting state of the outboard.

The engine holder 4 is provided at its front portion with a pair of engine mounts 10. The drive housing 6 is also provided at its front portion with a pair of engine mounts 11. These two pairs of engine mounts 10 and 11 are connected, at the front ends thereof, to a clamp bracket 12, which is fixed to a transom board of a hull (not shown).

A drive shaft 13, which is connected to the lower end of the crankshaft 3 of the engine 2 so as to be rotatable together therewith, extends through the drive housing 6 and reaches the inside of the gear housing 7. The gear housing 7 rotatably supports a propeller shaft 14 extending in the lateral direction in FIG. 1. A propeller 15 is mounted on the rear end of the propeller shaft 14 so as to be rotatable together therewith. A bevel gear mechanism 16, which is disposed at a point of intersection of the drive shaft 13 and the propeller shaft 14, transmits a rotational motion of the drive shaft 13 to the propeller shaft 14 to drive and then rotate the propeller 15.

The engine 2 includes an assembled unit, which is composed of a crankcase 21, a cylinder block 22, a cylinder head 23 and a head cover 24 in this order from the front side of the engine 2 towards the rear side thereof. The crankcase 21 and the cylinder block 22 are connected to each other so that the mating faces thereof form a bearing portion by which the crankshaft 3 is supported rotatably. The cylinder head 23 and the head cover 24 form a V-shaped member, which opens rearward in a plan view of the engine. The V-shaped member has the first and second banks. Each of the cylinder head 23 and the head cover 24 is divided into two separate parts for forming the first and second banks.

Figure 2:
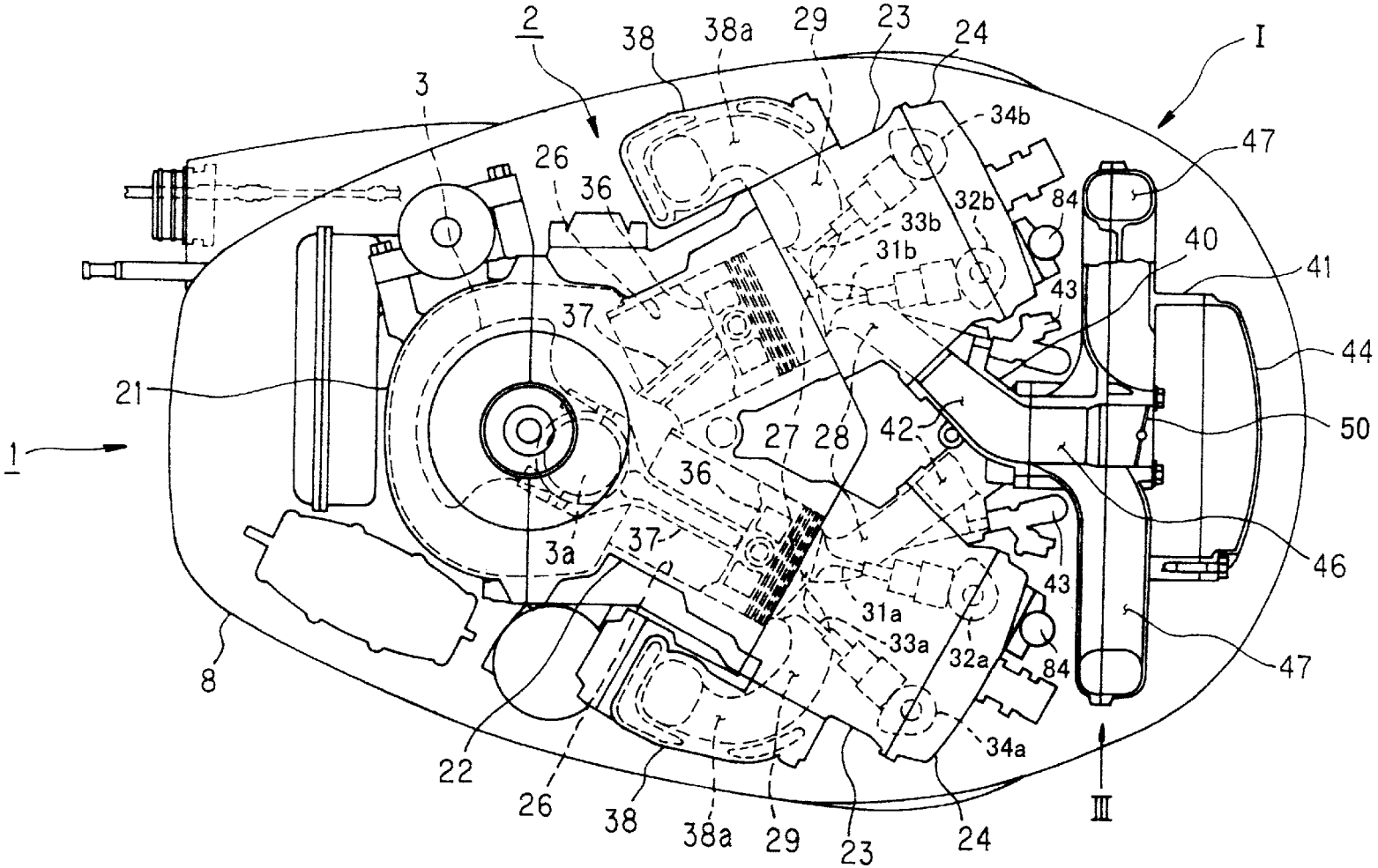
FIG. 2 is a plan view of the outboard motor viewed along an arrow II in FIG. 1.

As shown in FIG. 2, the cylinder block 22 has, in its inside, a pair of rows of cylinder bores 26, each row having three cylinder bores 26. Combustion chambers 27 are formed on the side of each of the cylinder heads 23 so as to align with the respective cylinder bores 26. Suction ports 28 and exhaust ports 29 communicating with the combustion chambers 27 are also formed on the side of each of the cylinder heads 23.

The intake ports 28 are opened to the inner surfaces of the V-shaped cylinder banks (i.e., the cylinder head 23). The intake ports 28 have communicating passages with the combustion chambers 27. Opening and closing of the communicating passages are controlled by means of intake valves 31*a*, 31*b* and intake camshafts 32*a*, 32*b*. The exhaust ports 29 are opened to the outer surfaces of the V-shaped member having the first and second cylinder banks. The exhaust ports 29 have communicating passages with the combustion chambers 27. Opening and closing of the communicating passages are controlled by means of exhaust valves 33*a*, 33*b* and exhaust camshafts 34*a*, 34*b*.

In view of the relationship to the V-shaped cylinder member having the first and second cylinder banks, the intake camshaft 32*a* and the exhaust camshaft 34*a*, which serve as the first pair of camshafts, may be referred to as the first inner camshaft and the first outer camshaft in the first cylinder bank, respectively, and the intake camshaft 32*b* and the exhaust camshaft 34*b*, which serve as second pair of camshafts, may be referred to as the second inner camshaft and the second outer camshaft in the second cylinder bank, respectively.

A valve train (valve moving mechanism), which includes the intake valves 31*a*, 31*b*, the intake camshafts 32*a*, 32*b*, the exhaust valves 33*a*, 33*b* and the exhaust camshafts 34*a*, 34*b*, is received in a valve train chamber 35 formed between the cylinder head 23 and the head cover 24. The valve train is operated, while receiving the supplied oil.

Pistons 36, which are slidably inserted in the cylinder bores 26, are connected to crankpins 3*a* eccentrically provided on the crankshaft 3 by means of connecting rods 37. Accordingly, a reciprocating motion of the piston 36 in the cylinder bore 26 is converted into a rotational motion of the crankshaft 3 to transmit force serving as an output power of the engine 2 to the drive shaft 13.

An exhaust manifold 38 has three upper inlet openings, which are connected to the exhaust ports 29 of provided on the left-hand side in FIG. 2, and a lower outlet opening, which is connected to the left-hand side surface of the engine holder 4. The other exhaust manifold 38 is provided on the right-hand side in FIG. 2 in the same manner as mentioned above. Each of the exhaust manifolds 38 has an exhaust collecting passage 38*a* (see FIG. 2) formed therein, in which exhaust gas discharged from the exhaust ports 29 for a set of the three cylinders is collected. The exhaust gas, which passes through the exhaust manifold 38, flows in exhaust passages, not shown, which are formed in the engine holder 4, the oil pan 5 and the drive housing 6, so as to be discharged into water.

As shown in FIG. 2, the engine 2 is provided, on the rear side of its central portion, with a surge tank 41 through an intake manifold 40. The intake manifold 40, which is for example formed of aluminum alloy, has six manifold-passages 42 for all the cylinders. These manifold-passages 42 are alternately connected to the intake ports 28, which are provided in the left and right-side cylinder banks (i.e., the cylinder heads 23). The manifold-passages 42 are provided with respective fuel injection devices 43 (i.e., fuel injectors). The fuel injection devices 43 have respective fuel injection directions, which are directed to deep portions of the intake ports 28.

The surge tank 41, which is for example a formed body of synthetic resin having a simple and rectangular shape, is provided on its back side, i.e., rear side, with a detachable cover 44 and at the uppermost position with a throttle body connection port 45 (see FIG. 1). The surge tank 41 has intake passages having the number of cylinders of the engine 2, i.e., six short high-speed intake passages 46 and six long low/middle-speed intake passages 47, which are formed integrally with the surge tank so as to extend.

A throttle body 48 formed into a separate body is connected to the throttle body connection port 45 of the surge tank 41 and a gas-liquid separation chamber 49, i.e., the air cleaner, is connected to the upper portion of the throttle body 48, to thereby form an intake system I (FIG. 1). The throttle body 48, which has a throttle valve provided therein to be openable or closable in a interlocking relation with operation of a throttle device, not shown, increases or decreases an amount of air supplied into the surge tank 41 to adjust the output of the engine 2.

When the engine 2 is operated in the low/middle-speed (revolution) range, the air sucked into the surge tank 41 through the throttle body 48 from the gas-liquid separation chamber 49 flows in the low/middle-speed intake passages 47 having a relatively long length. When the engine 2 is operated in the high-speed (revolution) range, the air flows in the high-speed intake passages 46 having a relatively short length. In either case, the fuel is injected by means of the fuel injection device 43, when passing through the intake manifold 40 (i.e., the manifold-passage 42) to form fuel-air mixture, which is to be supplied to the respective intake ports 28 of the engine 2.

Sucked air passes through the low/middle-speed intake passages 47 having a relatively long length in the low/middle-speed range, and on the one hand, the air passes through the high-speed intake passages 46 having a relatively short length in the high-speed range in this manner. As a result, utilization of intake inertial operation in the low/middle-speed range and the decreased resistance to the flow of air in the high-speed range make it possible to enhance an intake air charging efficiency in the widely expanded revolution (rpm) range of the engine, thus improving engine performance. Selection of the low/middle-speed intake passages 47 or the high-speed intake passages 46 is conducted through the operation of a butterfly valve 50 as shown in FIG. 2.

Figure 3:
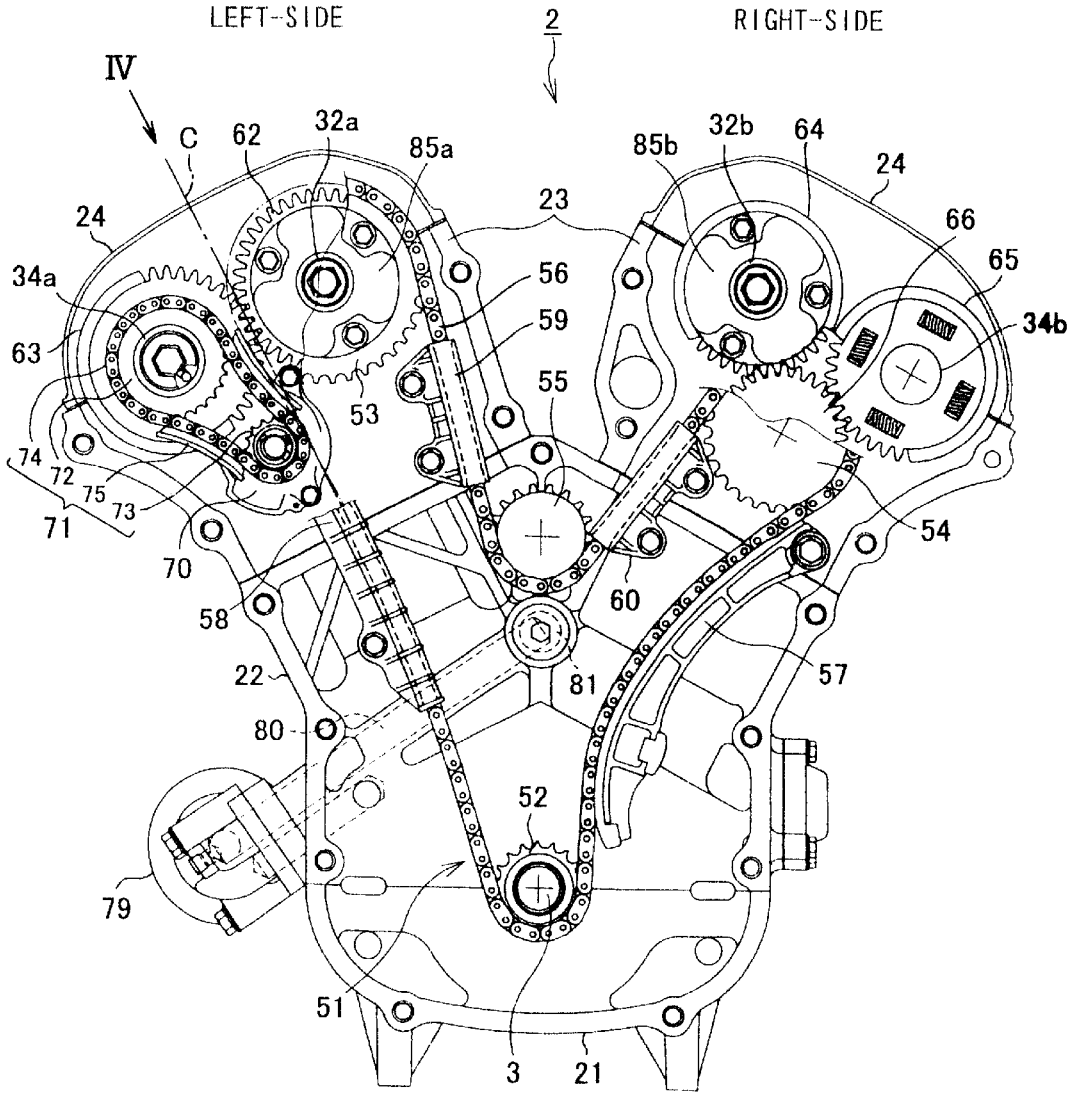
FIG. 3 is a bottom view of the engine taken along the line III—III in FIG. 1.
Figure 4:
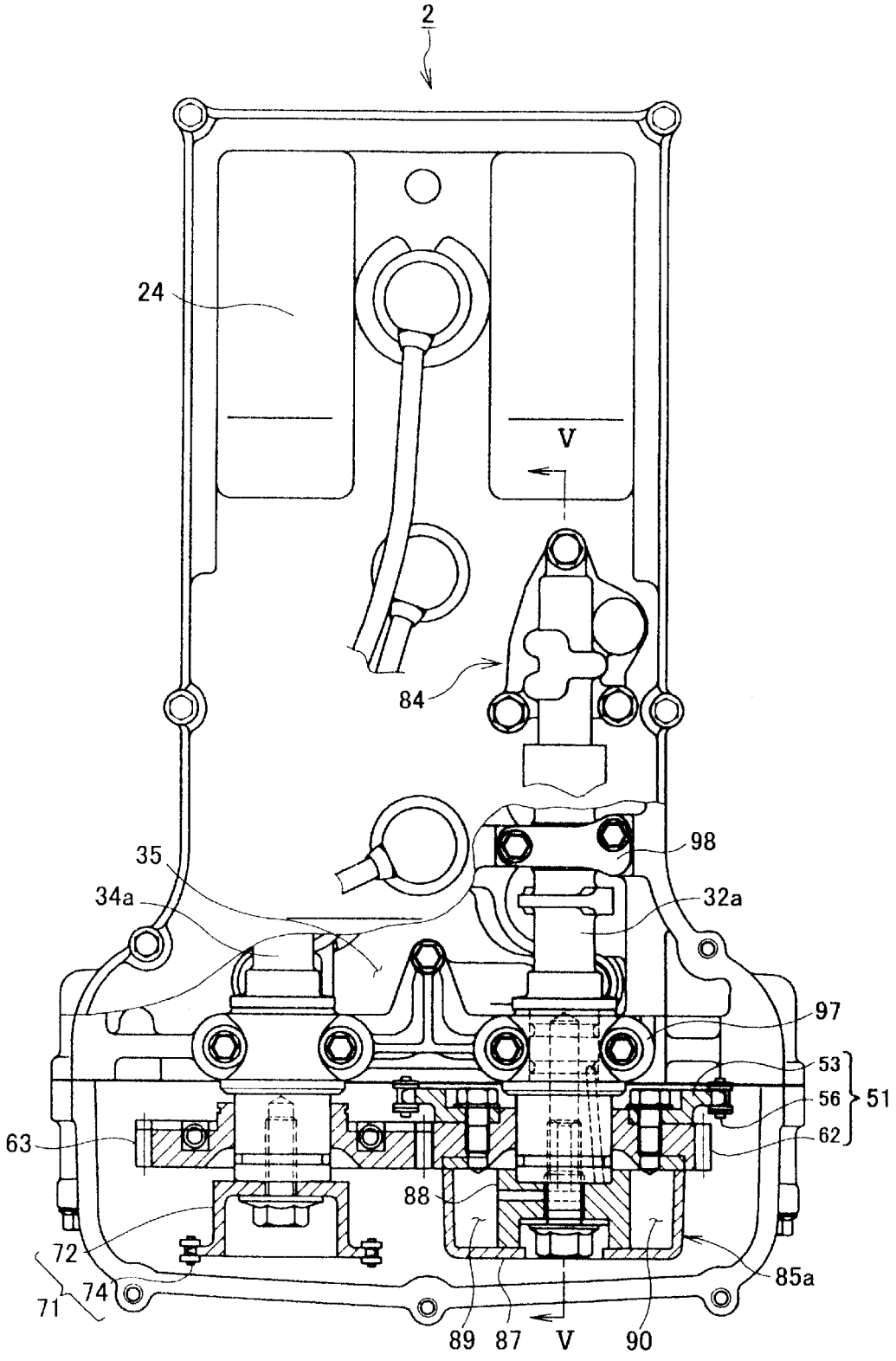
FIG. 4 is a view of the outboard motor viewed along an arrow IV in FIG. 3.

As shown in FIGS. 3 and 4, the engine 2 is provided on its lower side with a camshaft driving mechanism 51. The camshaft driving mechanism 51 transmits the rotational motion of the crankshaft 3 to the intake camshafts 32*a*, 32*b* and the exhaust camshafts 34*a*, 34*b*, which are disposed in the respective cylinder heads 23, through the combination of chains and gears.

The camshaft driving mechanism 51 has the following structure. That is, a cam-drive sprocket 52 is mounted to the crankshaft 3 in the vicinity of its lower end to be rotatable together with the crankshaft 3. A cam-driven sprocket 53 is also mounted, for example, to the intake camshaft 32*a* in the vicinity of its lower end, which is disposed in the left-hand cylinder bank, and on the one hand, a cam-driven sprocket 54 is rotatably supported on the lower surface of the cylinder head 23 of the right-hand cylinder bank.

In addition, an idle sprocket 55 is rotatably supported on the lower surface of the cylinder block 22 near the trough of the V-shaped bank member. A timing chain 56 is stretched over these sprockets 52, 53, 54 and 55. Furthermore, there are disposed, on the lower surface of the engine 2, a chain tensioner 57 for adjusting the tension of the timing chain 56 to maintain an appropriate state in addition to chain guides 58, 59 and 60 for guiding the timing chain 56.

In the left-hand side cylinder bank, a cam-drive gear 62 is mounted to the cam-driven sprocket 53 to be rotatable together therewith, which is disposed at the lower end of the intake camshaft 32*a*. The cam-drive gear 62 meshes with the cam-driven gear 63, which is disposed on the exhaust camshaft 34*a* in the vicinity of the lower end thereof to be rotatable together with the exhaust camshaft 34*a*.

In the right-hand side cylinder bank, the cam-driven gear 64, which is disposed on the intake camshaft 32*b* in the vicinity of the lower end thereof, and the cam-driven gear 65, which is disposed on the exhaust camshaft 34*b* in the vicinity of the lower end thereof, mesh with a cam-drive gear 66, which is disposed on the lower surface of the above-mentioned cam-driven sprocket 54 to be rotatable together therewith.

According to the camshaft driving mechanism 51 of the structure mentioned above, in the left-hand cylinder bank, the rotational motion of the crankshaft 3 is first transmitted to the intake camshaft 32*a* by means of the timing chain 56 and then to the exhaust camshaft 34*a* through the meshing of the cam-drive gear 62 and the cam-driven gear 63. The intake camshaft 32*a* rotates in the same direction as that of the crankshaft 3 and the exhaust camshaft 34*a* rotates in the direction opposite to that of the crankshaft 3.

In the right-hand cylinder bank, the rotational motion of the crankshaft 3 is first transmitted to the cam-driven sprocket 54 through the timing chain 56, and then to the intake camshaft 32*b* and the exhaust camshaft 34*b* thorough the meshing of the cam-drive gear 66 and the cam-driven gears 64, 65. Here, both the intake camshaft 32*b* and the exhaust camshaft 34*b* rotate in the opposite direction to that of the crankshaft 3.

In both the left- and right-hand cylinder banks, the intake camshafts 32*a*, 32*b* and the exhaust camshafts 34*a*, 34*b* are driven to rotate at half rotational speed of the crankshaft 3 to thereby control the opening/closing operation of the intake valves 31*a*, 31*b* and the exhaust valves 33*a*, 33*b* at the predetermined timing.

An oil pump 70 and an oil pump driving mechanism 71 are disposed in a region on the side opposite to the intake camshaft 32*a* to be driven, by means of chain, relative to the axial line C of the left-hand cylinder bank as shown in the plan view of the engine, i.e., FIG. 3. The oil pump 70 is secured, for example, to the lower surface of the cylinder head 23 so as to be positioned in the vicinity of the exhaust camshaft 34*a*.

The oil pump driving mechanism 71 is composed of an oil pump-drive sprocket 72, an oil pump-driven sprocket 73, an oil pump-drive chain 74 and a pair of chain guides 75. The oil pump-drive sprocket 72 is disposed to the lower surface of the cam-driven gear 63 so as to be rotatable together therewith, which is provided at the lower end of the exhaust camshaft 34*a*. The oil pump-driven sprocket 73 is disposed on a main shaft of the oil pump 70 to be rotatable together therewith. The oil pump-drive chain 74 is stretched over the sprockets 72, 73. When the engine 2 is in operation, the rotational speed of the exhaust camshaft 34*a* to be driven, by means of gear, is increased by the oil pump driving mechanism 71 so as to transmit power to the oil pump 70.

As shown in FIG. 1, an oil strainer 78 extends downward from the oil pump 70 to reach the bottom side of the oil pan 5. The operation of the oil pump 70 causes the oil reserved in the oil pan 5 to be sucked into the oil pump 70 through the oil strainer 78, thus discharging the oil at a prescribed pressure. The discharged oil flows in an oil passage, not shown, and is then filtered by means of oil filter 79 as shown in FIG. 3. Then, the oil flows in the other oil passage 80 and then flows into a main oil gallery 81, which is formed in the vicinity of the trough of the V-shaped member. The oil is supplied to the respective portions to be lubricated in the engine 2, a valve timing controlling mechanism 84 and valve timing adjusting mechanisms 85*a*, 85*b* under a prescribed pressure.

In view of the relationship to the V-shaped cylinder member having the first and second cylinder banks, the valve timing adjusting mechanisms 85*a*, 85*b* may be referred to as the first and second valve timing adjusting mechanisms in the first and second cylinder banks, respectively.

Figure 5:
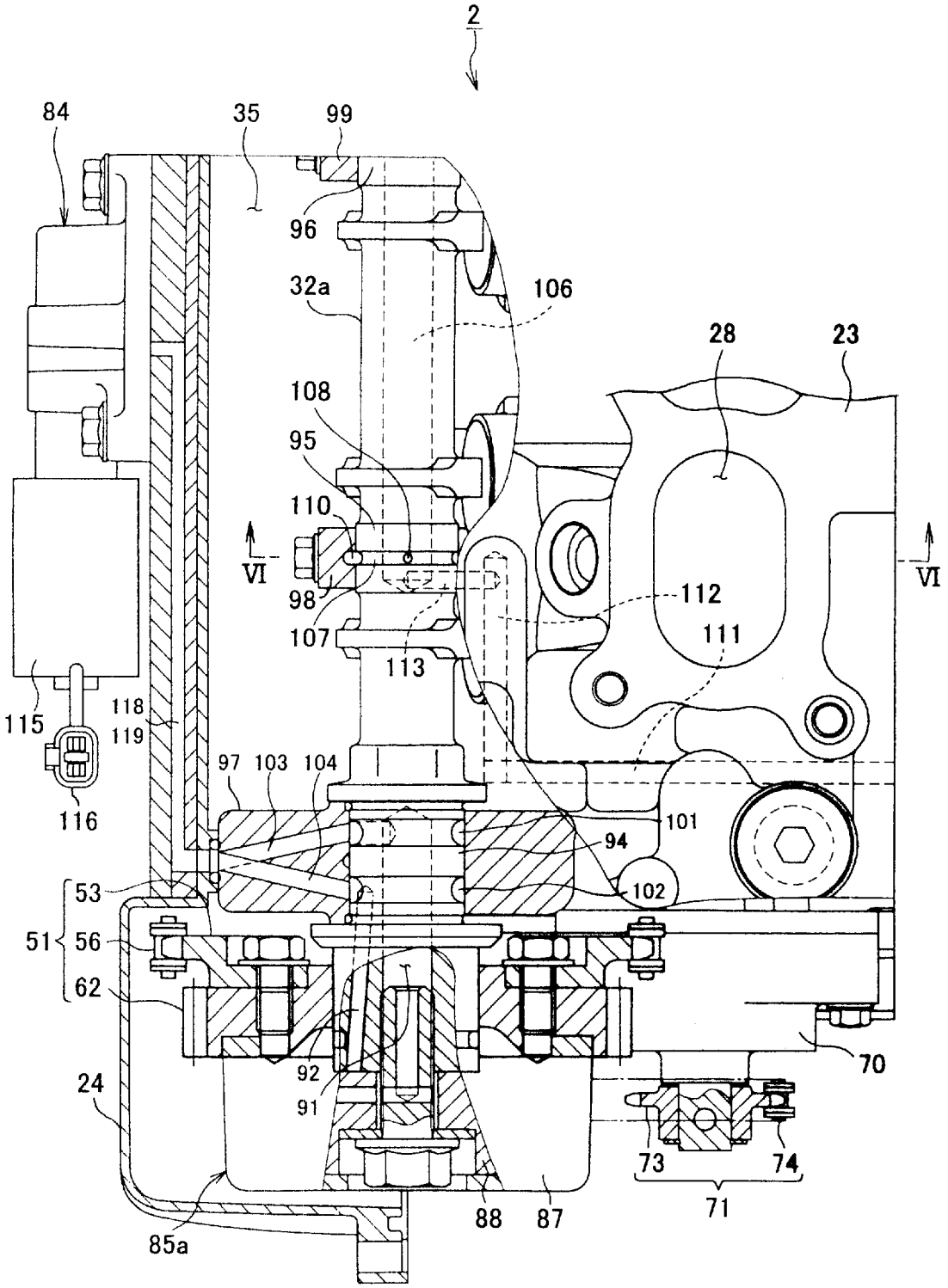
FIG. 5 is a vertical sectional view taken along the line V—V in FIG. 4, illustrating the embodiment of the present invention.

As shown in FIGS. 3 to 5, the valve timing adjusting mechanisms 85*a*, 85*b* are provided so as to be disposed (i) on the lower side of the camshafts, which are located on the inner side of the V-shaped member of the left and right-hand side cylinder banks in the plan view of the engine (i.e., FIG. 3), i.e., the intake camshafts 32, 32*b*, and (ii) below the camshaft driving mechanism 51 in the side view of the engine (i.e., FIGS. 4 and 5).

More specifically, in the left-hand side cylinder bank, the valve timing adjusting mechanism 85*a* is disposed on the lower surface of the cam-drive gear 62, which is provided on the intake camshaft 32*a* in the vicinity of the lower end thereof. In the right-hand side cylinder bank, the valve timing adjusting mechanism 85*b* is disposed on the lower surface of the cam-driven gear 64, which is provided on the intake camshaft 32*b* in the vicinity of the lower end thereof.

As shown in FIGS. 4 and 5, the valve timing adjusting mechanism 85*a* is provided with a housing member 87 having a bowl-shape, which is rotatable together with the cam-drive gear 62, and also provided with a boss member 88, which is rotatable together with the intake camshaft 32*a*. The housing member 87 is provided with a vane, not shown, on its inner periphery a vane, and the boss member 88 is also provided with another vane, not shown, on its outer periphery. These vanes are combined with each other so that respective blades of the vanes are arranged alternatively to form a spark advance side chamber 89 and a spark lag side chamber 90 in the respective spaces between the blades of the vane. The rotation of the housing member 87 relative to the boss member 88 varies a volume ratio of the spark advance side chamber 89 to the spark lag side chamber 90. The valve timing adjusting mechanism 85*b* also has the same structure as described above.

As shown in FIG. 5, the intake camshaft 32*a* (32*b*) has a spark advance side oil passage 91 and a spark lag side oil passage 92, which are formed in the intake camshaft 32*a* (32*b*). The spark advance side oil passage 91 communicates with the spark advance side chamber 89 and extends upward along the central axis of the intake camshaft 32*a* (32*b*). The spark lag side oil passage 92 communicates with the spark lag side chamber 90 and extends eccentrically and obliquely to the spark advance side oil passage 91.

The intake camshaft 32*a* (32*b*) is provided, at its lower end and middle portions, with a plurality of journal members 94, 95, 96 . . . , which are rotatably supported by means of a plurality of bearing members 97, 98, 99 . . . that are disposed in the cylinder head 23. The lowermost journal member 94 has, on its outer peripheral surface, two oil grooves 101, 102, which are formed so as to extend in the circumferential direction of the journal member. The spark advance side oil passage 91 communicates with the upper oil groove 101 and the spark lag side oil passage 92 communicates with the lower oil groove 102.

The lowermost bearing member 97 is provided, in its inside, with a journal oil passage 103 communicating with the upper oil groove 101 of the journal member 94 and the other journal oil passage 104 communicating with the lower oil groove 102 thereof.

Figure 6:
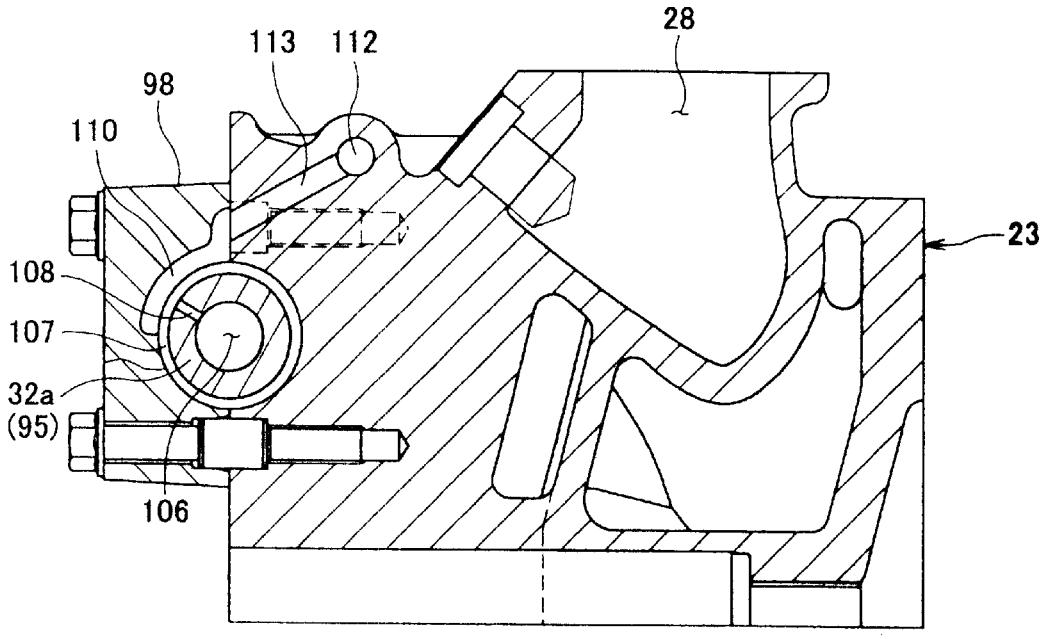
FIG. 6 is a cross-sectional view taken along the line VI—VI in FIG. 5.

As shown in FIG. 6, the intake camshaft 32*a* (32*b*) has an axial oil passage 106, which is formed along the central axial line of the intake camshaft 32*a* (32*b*). The axial oil passage 106 does not communicate with the above-mentioned spark advance side oil passage 91. The penultimate journal member 95 has, on its outer peripheral surface, an oil groove 107 extending in the circumferential direction of the journal member 95. The oil groove 107 communicates with the axial oil passage 106 through an oil aperture 108. The journal members 96 . . . , which are disposed above the journal member 94 have the similar structure.

The bearing member 98, which rotatably supports the penultimate journal member 95, has on its inner peripheral surface an oil recess 110 to which the oil from the oil pump 70 is supplied under pressure through oil passages 111, 112, 113. The supplied oil lubricates the contact surfaces of the journal member 95 and the bearing member 98 and enters the axial oil passage 106 from the oil aperture 108 to flow upward, thus lubricating the upper respective journal members 96 . . . and the upper respective bearing members 99 . . . .

The valve timing controlling mechanism 84 controls the valve timing adjusting mechanisms 85*a*, 85*b*. The valve timing controlling mechanism 84 is disposed on a member, which forms an outer wall of the valve train chamber 35 for the left and right-hand side cylinder banks, for example on the lower side of a ceiling surface of the head cover 24, as shown in FIGS. 1, 2, 4 and 5. The oil pump 70 and the valve timing controlling mechanism 84 are connected to each other through an oil passage, not shown. The valve timing controlling mechanism 84 is additionally provided with an actuator 115 such as a solenoid. Operating voltage is applied to the actuator 115 through a harness 116.

A spark advance side oil supply passage 118 and a spark lag side oil supply passage 119 extend in parallel from the valve timing controlling mechanism 84 so as to communicate with the journal oil passages 103, 104, respectively. The spark advance side oil supply passage 118 and the spark lag side oil supply passage 119 are formed along the contact surfaces of the valve timing controlling mechanism 84 and the head cover 24.

In the low/middle-speed (revolution) range of the engine 2, a control device, not shown, sends an input signal to the valve timing controlling mechanism 84 (i.e., the actuator 115) so that the valve timing controlling mechanism 84 applies an oil pressure from the oil pump 70 to the spark lag side oil supply passage 119. The pressure oil passes through the journal oil passage 104, the oil groove 102 and the spark lag side oil passage 92 to apply a pressure to the spark lag side chambers 90 of the valve timing adjusting mechanisms 85*a*, 85*b*.

As a result, the volume of the spark lag side chamber 90 increases and the volume of the spark advance side chamber 89 decreases so that the rotational phase angles of the boss member 88 and the intake camshafts 32*a*, 32*b* relative to the housing member 87 and the cam drive gear 62 or the cam driven gear 64, respectively, are shifted in the spark lag side direction. The valve timing of the engine 2 is therefore delayed so as to match with the low/middle-speed range.

On the contrary, the valve timing controlling mechanism 84 applies the oil pressure from the oil pump 70 to the spark advance side oil supply passage 118 in the high-speed (revolution) range (for example, at least 4,000 rpm) of the engine 2. The pressure oil passes through the journal oil passage 103, the oil groove 101 and the spark advance side oil passage 91 so as to apply pressure to the spark advance side chambers 89 of the valve timing adjusting mechanisms 85*a*, 85*b*.

As a result, the volume of the spark advance side chamber 89 increases and the volume of the spark lag side chamber 90 decreases so that the rotational phase angles of the boss member 88 and the intake camshafts 32*a*, 32*b* relative to the housing member 87 and the cam drive gear 62 or the cam driven gear 64, respectively, are shifted in the spark advance side direction. The valve timing of the engine 2 is therefore advanced so as to match with the high-speed range.

The oil pressure is always applied to the oil grooves 101, 102 formed in the lowermost journal member 94 as well as the journal oil passages 103, 104 formed in the lowermost bearing member 97, thus maintaining an appropriate lubrication of the journal member 94 and the bearing member 97.

The engine 2 has the structure in which the valve timing controlling mechanism 84 for controlling the valve timing adjusting mechanisms 85*a*, 85*b* is disposed below the head cover 24 forming the outer wall of the valve train chamber 35. It is therefore possible to decrease the length of both of the oil passage, not shown, running from the oil pump 70 to the valve timing controlling mechanism 84 and the oil passage running from the valve timing controlling mechanism 84 to the valve timing adjusting mechanisms 85*a*, 85*b* (i.e., the spark advance side oil supply passage 118, the spark lag side oil supply passage 119, the journal oil passages 103, 104, the spark advance side oil passage 91 and the spark lag side oil passage 92) so as to reduce the passage loss of the oil, thus improving the actuating response of the valve timing adjusting mechanisms 85*a*, 85*b*.

In addition, it becomes possible to form all the oil passages in the inside of the engine 2, without providing them in the form of external piping, to thereby decrease the number of necessary structural parts and the number of assembling steps, thus remarkably reducing costs. When an excessively large amount of the pressure oil is supplied to the valve timing controlling mechanism 84, the excess oil can be returned to the oil pan 5 through the valve train chamber 35, thus providing a convenient structure.

The respective disposition of the valve timing controlling mechanisms 84 on the cylinder banks makes it possible not only to set the different valve timing between the left- and right-hand cylinder banks, but also to improve the actuating response. The valve timing controlling mechanism 84 is not necessarily disposed on the head cover 24, but it may be disposed on the outer surface of the cylinder head 23, which forms the outer wall of the valve train chamber 35.

The engine 2 has the features that the lowermost journal member 94 of each of the intake camshafts 32*a*, 32*b* has the oil grooves 101, 102 formed thereon, and the lowermost bearing member 97, which rotatably supports the journal member 94, has the journal oil passages 103, 104 that are formed in the inside of the lowermost bearing member 97 so as to communicate with the oil grooves 101, 102. On the one hand, the engine 2 has the further features that each of the intake camshafts 32*a*, 32*b* has the spark advance side oil passage 91 and the spark lag side oil passage 92, which are formed in the inside of the intake camshaft so as to communicate with the oil grooves 101, 102 and the valve timing adjusting mechanism 85*a*, 85*b*. It is therefore possible to minimize the length of the oil passage running from the valve timing controlling mechanism 84 to the valve timing adjusting mechanism 85*a*, 85*b*, thus further remarkably improving the actuating response.

The axial oil passage 106, which is formed in the inside of the intake camshaft 32*a*, 32*b*, conducts oil supply to the penultimate journal member 95 and the other journal members 96 . . . located thereabove, as well as the penultimate bearing member 98 and the other bearing members 99 . . . located thereabove. As a result, there is no complex combination of many oil apertures, grooves and passages in the lowermost journal member 94 and the lowermost bearing member 97, thus avoiding a complicated structure of these parts and complicated working steps to be carried out.

Forming the spark advance side oil passage 91 and the spark lag side oil passage 92, which communicate with the valve timing adjusting mechanisms 85*a*, 85*b*, in the inside of the intake camshafts 32*a*, 32*b* makes it possible to facilitate the oil supply to the valve timing adjusting mechanisms 85*a*, 85*b* serving as rotational members.

In addition, disposing the valve timing adjusting mechanisms 85*a*, 85*b* on the lower end side of the intake camshafts 32*a*, 32*b* and below the camshaft driving mechanism 51 makes it possible to make effective use of a space below the engine 2 so as to provide the more improved properties of layout-designing and downsizing the engine 2 and to reduce the distance between the valve timing adjusting mechanism 85*a*, 85*b* and the valve timing controlling mechanism 84 so as to remarkably improve the actuating response of the valve timing adjusting mechanism 85*a*, 85*b*. Further, disposing the heavy-weight components such as the valve timing adjusting mechanisms 85*a*, 85*b* on the lower side of the engine 2 also makes it possible to lower the position of the center of gravity of the outboard motor 1.

There are additional structural features. That is: (i) the camshaft driving mechanism 51 has a structure in which the rotational motion of the crankshaft 3 is transmitted to the intake camshaft 32*a* by means of the timing chain 56 in the left-hand side cylinder bank. Therefore, the rotational motion of the intake camshaft 32*a* is transmitted to the exhaust camshaft 34*a* by means of the gears 62, 63, and the valve timing adjusting mechanism 85*a* is disposed at the lower end of the intake camshaft 32*a*, and (ii) the oil pump 70 and the oil pump driving mechanism 71 are disposed in the region on the side opposite to the intake camshaft 32*a* relative to the axial line C of the cylinder bank so that the rotational motion of the exhaust camshaft 34*a* is transmitted to the oil pump 70 by means of the oil pump driving mechanism 71.

It is therefore possible to level the valve timing adjusting mechanism 85*a*, which is provided, on the side of the intake camshaft 32*a* to be chain-driven, with the oil pump 70 and the oil pump driving mechanism 71, which are provided on the exhaust camshaft 34*a* to be driven by the gear in the side view of the engine, thus making effective use of the space below the engine 2 and providing the more improved property of downsizing the engine 2.

The chain-driving system applied to the oil pump driving mechanism 71 makes it possible to dispose the oil pump 70, without being influenced by the cam-drive gear 62 having a relatively large diameter, the cam-driven gear 63 and the valve timing adjusting mechanism 85*a*. Accordingly, the distance between the exhaust camshaft 34*a* and the shaft of the oil pump can be set in a desirable fashion, thus providing a high degree of freedom in layout.

In addition, the valve timing adjusting mechanisms 85*a*, 85*b* are provided for the intake camshafts 32*a*, 32*b* (i.e., the first inner camshaft 32*a* and the second inner camshaft 32*b*), which serve as the camshafts disposed in the inner sides of the first and second cylinder banks in the plan view of the engine 2. It is therefore possible to dispose the valve timing adjusting mechanisms 85*a*, 85*b* having a relatively large diameter on the inner side of the engine 2 in the lateral direction thereof, thus decreasing the total width of the engine 2, and hence, downsizing the engine 2 as well as the whole outboard motor 1.

The engine 2 has a further additional feature that the gas-liquid separation chamber 49 for the intake system is disposed on the upper side of the engine body and the valve timing adjusting mechanisms 85*a*, 85*b* are disposed on the lower side thereof. Such a structural feature causes no spatial interference of the gas-liquid separation chamber 49 with the valve timing adjusting mechanisms 85*a*, 85*b*, thus providing the improved properties of layout-designing and downsizing the engine in such an aspect.

Figure 7:
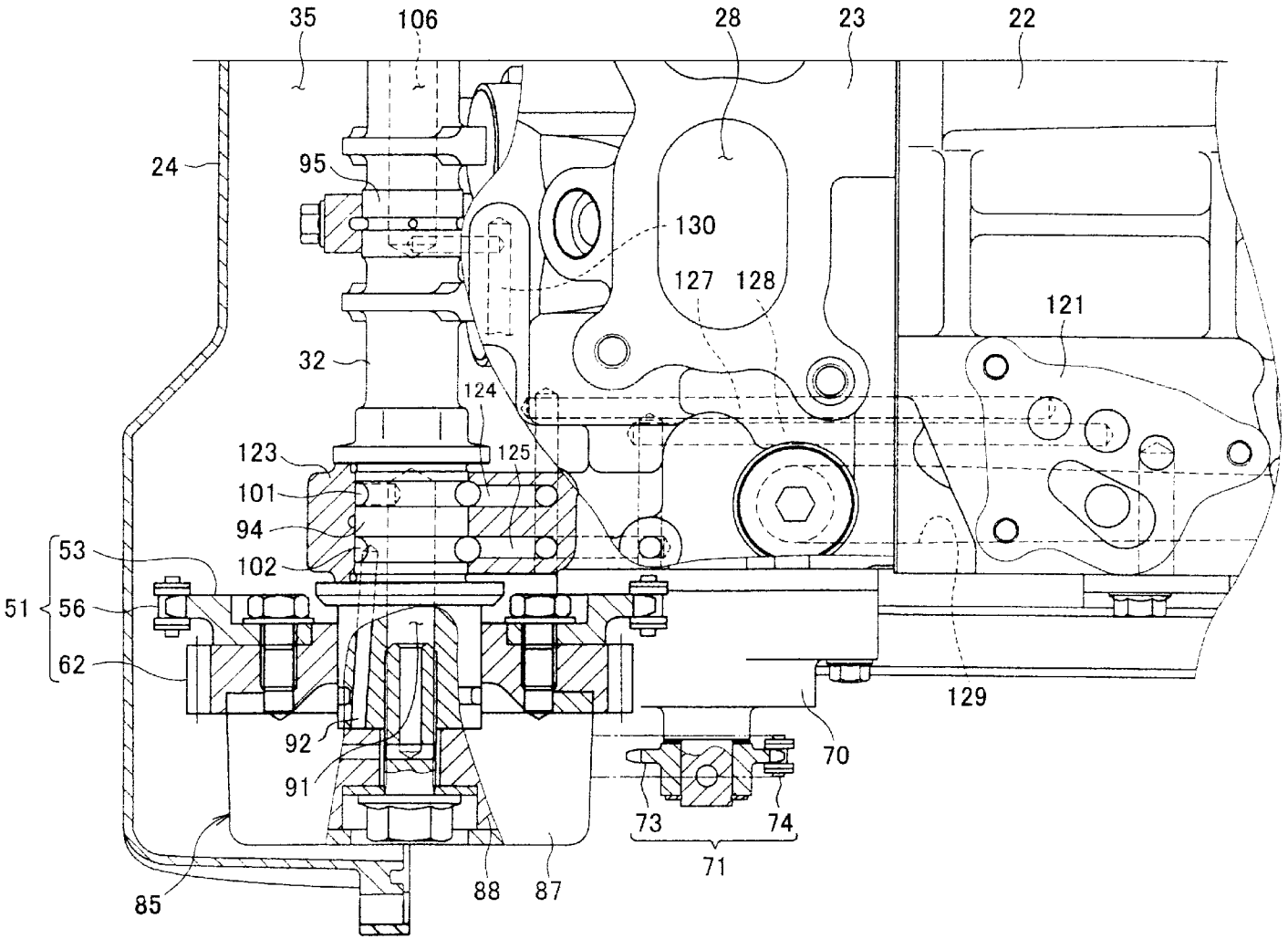
FIG. 7 is a vertical sectional view illustrating a modified example of the present invention.

FIG. 7 shows a modification of the present invention. In such a modification, the valve timing controlling mechanism, not shown, is disposed on a flat mounting surface 121, which is formed on the lower side portion of the cylinder block 22. The modification has the same structure of the rotational members such as the intake camshaft 32 and the valve timing adjusting mechanism 85 and the same structure of the peripheral components relative to the oil pump 70 as those illustrated in FIG. 5.

A bearing member 123, which rotatably supports the lowermost journal member 94 of the intake camshaft 32, is provided in its inside with a journal oil passage 124 communicating with the upper oil groove 101 of the journal member 94 and the other journal oil passage 125 communicating with the lower oil groove 102 thereof. A spark advance side oil supply passage 127, which extends from the mounting surface 121, communicates with the journal oil passage 124, and a spark lag side oil supply passage 128, which extends from the same mounting surface 121, communicates with the journal oil passage 125. An oil passage 129, which extends from the oil pump 70, communicates with the fitting surface 121. Oil is supplied from the main oil gallery through an oil passage 130 to the axial oil passage 106 for supplying the oil to the penultimate journal member 95 of the intake camshaft 32 and the other journal members 96 . . . located thereabove.

According to the above-described structure, the oil is supplied from the oil pump 70, through the oil passage 129, the spark lag side oil supply passage 128, the journal oil passage 125, the oil groove 102 and the spark lag side oil passage 92, to the spark lag side chamber of the valve timing adjusting mechanism 85 in the low/middle-speed rpm range of the engine 2, so as to delay the valve timing of the engine 2. The oil is supplied from the oil pump 70, through the oil passage 129, the spark advance side oil supply passage 127, the journal oil passage 124, the oil groove 101 and the spark advance side oil passage 91, to the spark advance side chamber of the valve timing adjusting mechanism 85 in the high-speed rpm range of the engine 2, so as to advance the valve timing of the engine 2.

Furthermore, in the above-described structure, there is a short distance between the valve timing controlling mechanism secured on the mounting surface 121 and the oil pump 70 and the valve timing adjusting mechanism 85. It is therefore possible to decrease the length of the oil passage 129 running from the oil pump 70 to the valve timing controlling mechanism (or the mounting surface 121), as well as the respective oil passages such as the spark advance side oil supply passage 127, the spark lag side oil supply passage 128 and the journal oil passages 124, 125, thus improving the actuating response of the valve timing adjusting mechanism 85.

According to the present invention, although application of the above-described structure is not limited only to the V-type engine, the structure may be applied to a four-stroke-cycle engine having different cylinder arrangement, for example, applicable to an in-line-type engine.

It is further to be noted that many other changes and modifications may be made without departing from the scopes of the appended claims.

What is claimed is:

1. A four-stroke-cycle engine of an outboard motor, comprising:

an engine body;

a crankshaft disposed in an upright state in the engine body of the engine in an upright state;

at least one camshaft disposed in an upright state in the engine body;

at least one camshaft driving mechanism for transmitting a rotational motion of the crankshaft to the camshaft, said camshaft driving mechanism being disposed on a lower side of the engine body;

an oil pump for lubrication disposed on the lower side of the engine body;

at least one valve timing adjusting mechanism; and at least one valve timing controlling mechanism to which an oil is to be supplied from the oil pump to control the valve timing adjusting mechanism, said valve timing controlling mechanism being disposed on a lower side of an outer wall of a valve train chamber in which said camshaft is received.

2. A four-stroke-cycle engine of an outboard motor according to claim 1, wherein said valve timing adjusting mechanism is disposed on a lower end side of the camshaft and below the camshaft driving mechanism.

3. A four-stroke-cycle engine of an outboard motor according to claim 2, further comprising an intake device including a gas-liquid separation chamber, which is disposed on an upper side of the engine body.

4. A four-stroke-cycle engine of an outboard motor according to claim 1, wherein said engine is a double-overhead-camshaft (DOHC) type engine, said at least one camshaft comprises first and second camshaft members, said camshaft driving mechanism is configured so that the rotational motion of the crankshaft is transmitted to the first camshaft member through a chain and a rotational motion of the first camshaft member is transmitted to the second camshaft member through a gear train; said valve timing adjusting mechanism is disposed on a lower end of said first camshaft to be driven by a chain; said oil pump and an oil pump driving mechanism are disposed in a region on a side opposite to said first camshaft member to be driven by a chain relative to an axial line of a cylinder of the engine in a plan view; and a rotational motion of said second camshaft member to be driven by a gear is transmitted to the oil pump through the oil pump driving mechanism.

5. A four-stroke-cycle engine of an outboard motor according to claim 1, wherein said engine is a double-overhead-camshaft (DOHC) and V-type engine having a V-shape bank in a plan view and said valve timing adjusting mechanism is disposed for the camshaft disposed inside the V-shape bank.

6. A four-stroke-cycle engine of an outboard motor according to claim 5, wherein said at least one camshaft comprises first and second pairs of camshaft members, the first pair of camshaft members comprising a first inner camshaft member and a first outer camshaft member, which are disposed in a first bank of the V-type engine, and the second pair of camshaft members comprising a second inner camshaft member and a second outer camshaft member, which are disposed in a second bank of the V-type engine, said first and second inner camshaft members being located between said first and second outer camshaft members in the plan view, and said at least one valve timing adjusting mechanism comprises first and second valve timing adjusting devices provided for said first and second inner camshaft members, respectively.

* * * * *